US007815797B1

(12) United States Patent
Keith

(10) Patent No.: US 7,815,797 B1
(45) Date of Patent: Oct. 19, 2010

(54) POOL, SKIMMER PRE-FILTER ASSEMBLY

(75) Inventor: Danny A. Keith, Morrow, OH (US)

(73) Assignee: Zone Filtration, Inc., Morrow, OH (US)

( * ) Notice: Subject to any disclaimer, the term of this patent is extended or adjusted under 35 U.S.C. 154(b) by 138 days.

(21) Appl. No.: 12/229,656

(22) Filed: Aug. 27, 2008

(51) Int. Cl.
*E04H 4/12* (2006.01)

(52) U.S. Cl. ..... 210/167.19; 210/315; 210/416.2; 210/477

(58) Field of Classification Search ..... 210/167.1, 210/167.19, 314, 315, 416.1, 416.2, 448, 210/471, 477, 488, 489
See application file for complete search history.

(56) References Cited

U.S. PATENT DOCUMENTS

| | | | | |
|---|---|---|---|---|
| 1,728,381 | A | 9/1929 | Waters | |
| 1,734,841 | A | 11/1929 | Walden | |
| 2,464,921 | A * | 3/1949 | Harvey | 210/495 |
| 2,980,256 | A | 4/1961 | Nash | |
| 3,252,576 | A | 5/1966 | Miller | |
| 3,497,071 | A | 2/1970 | Mineo | |
| 3,731,815 | A | 5/1973 | Collingwood et al. | |
| 4,022,690 | A * | 5/1977 | Smith | 210/167.1 |
| 4,204,966 | A * | 5/1980 | Morgan, Jr. | 210/455 |
| 4,221,670 | A | 9/1980 | Ziemek | |
| 4,743,368 | A | 5/1988 | Gates | |
| 4,826,591 | A | 5/1989 | Macia | |
| 4,836,931 | A | 6/1989 | Spearman et al. | |
| 5,045,194 | A | 9/1991 | Gershenson | |
| 5,188,731 | A * | 2/1993 | Lapoint, Jr. | 210/232 |
| 5,202,020 | A * | 4/1993 | Desjoyaux et al. | 210/446 |
| 5,417,855 | A * | 5/1995 | Gershenson | 210/315 |
| 5,605,622 | A | 2/1997 | Ferraro | |
| 5,888,386 | A * | 3/1999 | Enright et al. | 210/167.11 |
| 6,007,714 | A | 12/1999 | Keith | |
| 6,471,856 | B1 * | 10/2002 | Keith | 210/167.12 |
| 6,962,660 | B2 * | 11/2005 | Wybo | 210/315 |
| 2002/0117432 | A1 * | 8/2002 | Lincke | 210/169 |
| 2004/0149666 | A1 * | 8/2004 | Leaverton | 210/767 |

* cited by examiner

*Primary Examiner*—Fred Prince
(74) *Attorney, Agent, or Firm*—Charles R. Wilson

(57) ABSTRACT

A pre-filter assembly is for use in a skimmer of a residential swimming pool. The pre-filter comprises a skimmer collar and a cleanable filter basket. The skimmer collar is for placement on a rim of a below water surface opening within the skimmer. The cleanable filter basket is made of a water porous material. The filter basket is permanently secured at an edge defining the open-top to the skimmer collar. The filter basket further has a chevron shape for ease of use. Swimming water debris is trapped in the filter basket as pool water is pulled through the filter basket on its way to a primary filter apparatus. The filter basket is easily cleaned as needed and replaced.

14 Claims, 4 Drawing Sheets

POOL, SKIMMER PRE-FILTER ASSEMBLY

FIELD OF THE INVENTION

This invention relates to a swimming pool pre-filter assembly. More particularly, the invention relates to a pre-filter assembly for use in a swimming pool skimmer to filter debris from the pool water prior to reaching a primary filter apparatus.

BACKGROUND OF THE INVENTION

Water in residential swimming pools is continuously filtered to remove debris, including airborne material such as fallen leaves and other tree droppings, insects, and material brought into the pool by the swimmer such as hair and lint. The typical pool has a water intake line which draws water from at least the surface of the pool and often from the bottom of the pool as well. The water at the surface level is initially pulled into a skimmer, through a skimmer basket, through a primary filter apparatus, and finally returned to the pool. Sand or diatomaceous earth are common filter medias used in the primary filter apparatus. Periodically, the filter media becomes clogged and must be replaced. The pool owner must disassemble the filter apparatus, remove the filter media, discard the filter media, add fresh filter media to the filter apparatus, and reassemble the filter apparatus. This can easily take up to an hour.

An auxiliary filter assembly to lessen or even eliminate the current necessity of periodic replacing the filter media in the filter apparatus is described in my U.S. Pat. No. 6,007,714. The product has proven itself effective for its intended use. Those who have used it have attested to its ability to filter out much pool debris prior to the debris reaching the primary filter apparatus. Necessarily, less debris in the primary filter apparatus means it can be used longer prior to a need to replace its filter media. A full summer of pool use without changing the filter media is often experienced and is much appreciated by the pool owner.

As successful as my auxiliary filter assembly of U.S. Pat. No. 6,007,714 has been, it can be and has been improved upon. The pool skimmer pre-filter of this invention is cheaper to manufacture and easier to use, all the while being as effective. The pre-filter of the invention effectively filters a significant amount of debris from the swimming pool water before it reaches the pool's primary filter assembly. The pre-filter is very conveniently cleaned and reused. The pool owner now has a cost effective means to keep the pool water clean with minimal effort.

SUMMARY OF THE INVENTION

A pre-filter assembly is adapted for use in a skimmer of residential swimming pools. The assembly comprises a skimmer collar and a cleanable filter basket. The skimmer collar is dimensioned for placement on a rim of a below water surface opening found within the skimmer. The cleanable filter basket is made of a water porous material and is permanently secured to the skimmer collar. The filter basket has a chevron shape. A circular edge defines an upper open-top. The filter basket further has a lower closed bottom. Swimming water is pulled through the skimmer with debris trapped in the filter basket. The filter basket is easily cleaned simply by removing the pre-filter assembly from the skimmer and inverting it. Debris either falls freely or is easily manually forced out.

DETAILED DESCRIPTION OF THE INVENTION

Figure 1:
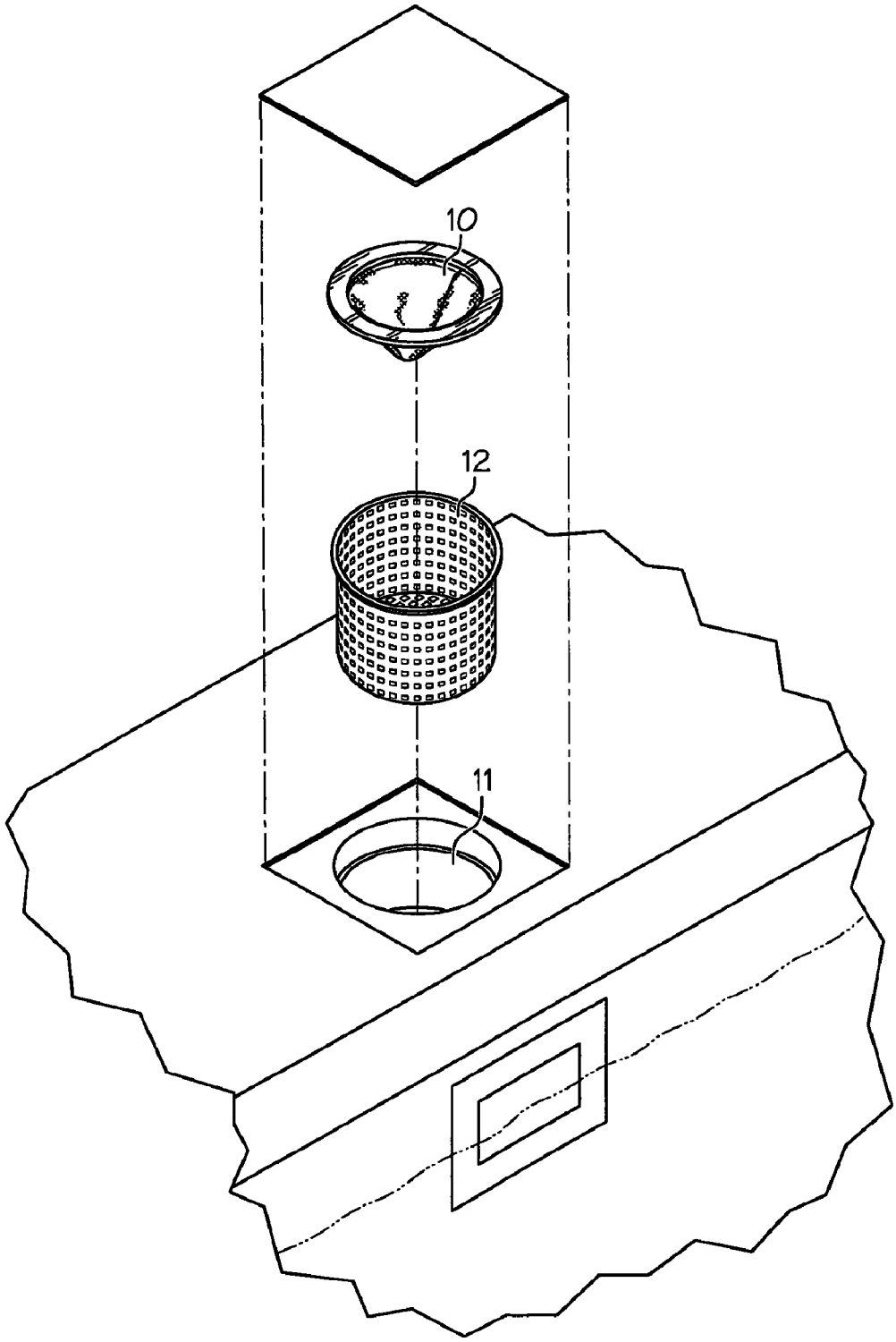
FIG. 1 is a perspective view of a skimmer portion of an in ground swimming pool showing an exploded view of a skimmer basket and the pre-filter assembly of the invention.

The pre-filter assembly of the invention is described in the following paragraphs and with reference to the drawings. While an in ground pool is depicted in the drawings, the pre-filter assembly is useful as well with an above ground pool.

With reference to FIG. 1, the pre-filter assembly 10 of the invention is intended to be used in the skimmer 11 of a residential swimming pool. The skimmer is conventional. It basically is a hole which is open on one side and in direct communication with the swimming pool to receive pool water. It is also open on top to allow access to a skimmer basket 12 removably positioned in the skimmer. A pipeline (not shown) leads from the bottom of the skimmer. A pump and primary filter apparatus (also not shown) draws water through the pipeline from the skimmer and returns it to the pool. As well known, the skimmer basket 12 is rigid with holes in a bottom wall and side walls. About one-quarter inch mesh openings in the skimmer basket filter out leaves and other large debris from flowing through the pipeline and clogging up the primary filter apparatus.

Figure 2:
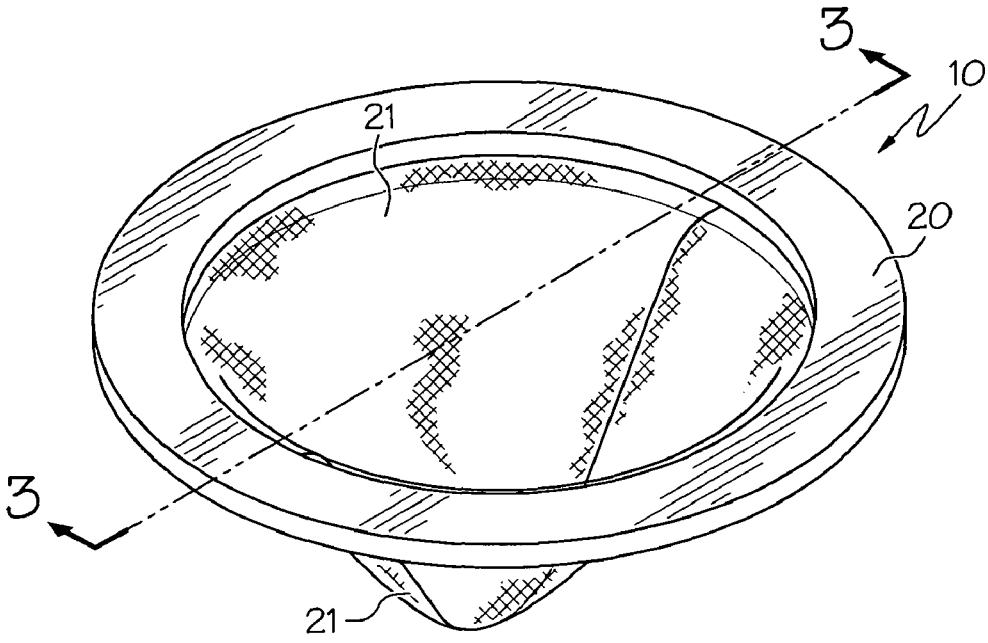
FIG. 2 is a perspective view of the pre-filter assembly of FIG. 1 isolated from the skimmer and skimmer basket of the swimming pool.
Figure 3:
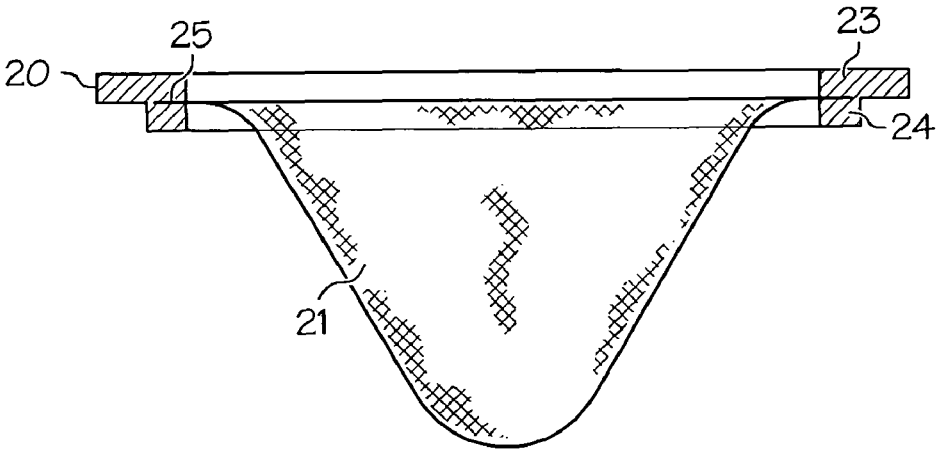
FIG. 3 is a side view in section of the pre-filter assembly of FIG. 2 taken along line 3-3 thereof.

The pre-filter assembly 10 works in conjunction with the skimmer basket 12 of the skimmer 11. As best seen in FIGS. 2 and 3, the pre-filter assembly 10 is unitary or one-piece. It comprises a skimmer collar 20 and a cleanable filter basket 21.

The skimmer collar 20 of the pre-filter assembly 10 is a substantially flat circular ring 23 with a downwardly extending inner lip 24. The skimmer collar 20 has an outside diameter sized to fit into the skimmer and rest on a rim of an opening within the skimmer which leads to the pipeline. The skimmer basket 12 also sits in the opening and necessarily the skimmer collar 20 of the pre-filter assembly rests on the basket's top edge as well. Preferably, the outside diameter of the skimmer collar is about five inches to about ten inches to stably rest on the opening's rim. Preferably, the inside diameter of the skimmer collar is about three inches to about eight inches, sized so as to not interfere with the flow of water into the skimmer basket. The width of the ring itself is preferably about one inch to about two inches while the thickness of the flat circular ring portion is about 100 mils to about 400 mils.

As apparent in FIG. 3, the skimmer collar 20 includes the downwardly extending inner lip 24. The lip 24 is essentially a ring dimensioned to have an outside diameter less than that of the skimmer collar and an inside diameter substantially the same as that of the skimmer collar. The lip's purpose is to extend into the skimmer basket during use to at least partially immobilize the pre-filter assembly 10 from laterally moving during use. This ensures that the skimmer collar is stabilized on all sides and the filter basket is properly positioned within the skimmer basket. A lip height of about one-fourth inch to about one-half inch is adequate for this purpose.

The skimmer collar 20, including its lip 24, is made of a substantially rigid material to withstand water forces created by the primary filter apparatus' pump in pulling water through the skimmer hole. The material also must be non-toxic and ideally have anti-bacterial properties to minimize bacteria growth on it. It also will not readily deteriorate in chlorinated water as typically found in swimming pools.

Still further, the skimmer collar is made of a material more dense than water so that it will not float. This aids in the pre-filter assembly remaining in place during use and, most importantly, staying in place during non-use intervals such as when the primary filter's pump is turned off. Examples of suitable materials used to make the skimmer collar include plastics made from synthetic resins such as polyvinylchlorides, polyurethanes, polyethylenes and polypropylenes. A preferred skimmer collar is made of a moldable thermoplastic resin such as polyethylene having a specific density of greater than about 1.0.

The filter basket 21 of water porous material is configured to be permanently attached at its top edge to the skimmer collar 20 and to fit into the skimmer basket. Still with reference to FIGS. 2 and 3, the filter basket 21 is chevron-shaped with a substantially circular upper open-top and a lower closed bottom. The top edge 25 defining the open-top is embedded in the skimmer collar between the substantially flat circular ring 23 and the lip 24. The filter basket preferably has an open-top diameter of about three inches to about eight inches and a height as measured from its top edge to its lowermost point of about three inches to about five inches. These dimensions are conducive to the top edge 25 of the filter basket 21 being permanently secured to the skimmer collar 20 and lower closed bottom fitting fully into the skimmer basket without touching a bottom wall of the basket. In use there is about one to three inches of head space between the lower closed bottom of the filter basket 21 and the bottom wall of the skimmer basket 12. This head space is needed to receive solid chlorine tablets and ensure proper water flow through the skimmer.

The filter basket 21 is made of a water porous material capable of filtering out swimming pool water debris. The porous material must allow water to pass through while retaining debris as small as 600 microns. Preferably, the porous material has a mesh opening size of from about 600 microns to about 1000 microns. A mesh opening size of about 700 microns to about 900 microns is more preferred. It has been found that the aforementioned mesh opening size traps most debris commonly found in pools without a concern over pump line cavitation. Even with a substantial amount of debris in the filter basket, water is still pulled through the porous material.

The porous material of the filter basket must also have a strength to withstand the forces of the water flow into the skimmer. A synthetic polymeric material such as polypropylene is economical as well as having the requisite strength and durability needed to withstand water forces experienced in the skimmer. It is highly preferred.

The pre-filter assembly 10 has a structure which is conducive to mass production. A larger ring and a smaller ring meeting the aforementioned dimensions for the skimmer collar's upper flat circular ring and depending lip are made of a thermoplastic material. The two rings are assembled together with the top edge of the filter basket positioned therebetween. The whole assembly is then subjected to temperatures to meld the rings together, thereby trapping the filter basket's top edge in the melded rings. Heat or ultrasound is suitable for the melding process. The top edge of the filter basket can as well be melded into the inner vertical surfaces of the flat circular ring and depending lip.

In use, the pre-filter assembly 10 is placed in the hole of skimmer 11 of the swimming pool and positioned on the rim of the skimmer's opening leading to the skimmer basket 12 and pipeline. The pre-filter assembly 10 can be left in place and trap debris over several days as pool water is pulled into the skimmer. Periodically, the whole assembly is removed. It is cleaned simply by inverting the filter basket and dumping trapped debris from it. Spraying water onto it aids in dislodging the debris. The filter basket is turned back to its original state and the pre-filter assembly repositioned in the skimmer.

Figure 4:
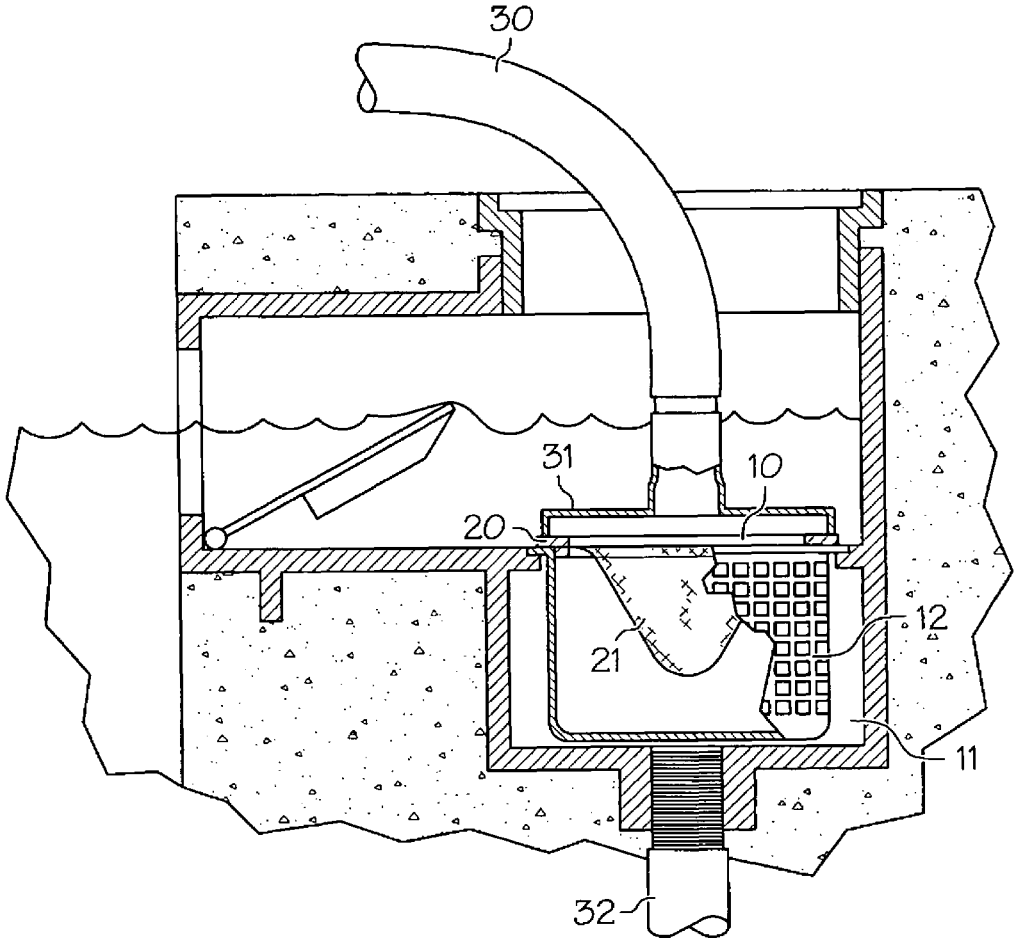
FIG. 4 is a side view partially in section showing operation of the pre-filter assembly of FIG. 1 in the process of removing debris from the swimming pool during a pool vacuuming operation.

As shown in FIG. 4, the pre-filter assembly can also be used to filter debris over just a few minutes time such as when a pool vacuum line 30 is used to periodically draw water and debris from the bottom of the pool and direct it through the filter basket 21 for a one-time cleaning effort. A vacuum line cap 31 at a terminus of the vacuum line 30 is initially positioned on top of the skimmer collar 20 of the pre-filter assembly 10. Pool water is now pulled from the bottom of the pool, through the vacuum line, through the filter basket 21, through the skimmer basket 12 and into a pipeline 32 leading to the primary filter apparatus. In this use, normally a substantial amount of debris pulled along with the pool water is trapped in the filter basket. When the pool bottom is cleaned, the vacuum line and its vacuum line cap are removed from the skimmer. The whole pre-filter assembly is now removed, cleaned and replaced. The debris which is normally pulled into the primary filter apparatus has again been diverted and necessarily substantially prolongs the time when the primary filter apparatus must itself be cleaned for proper operation.

Figure 5:
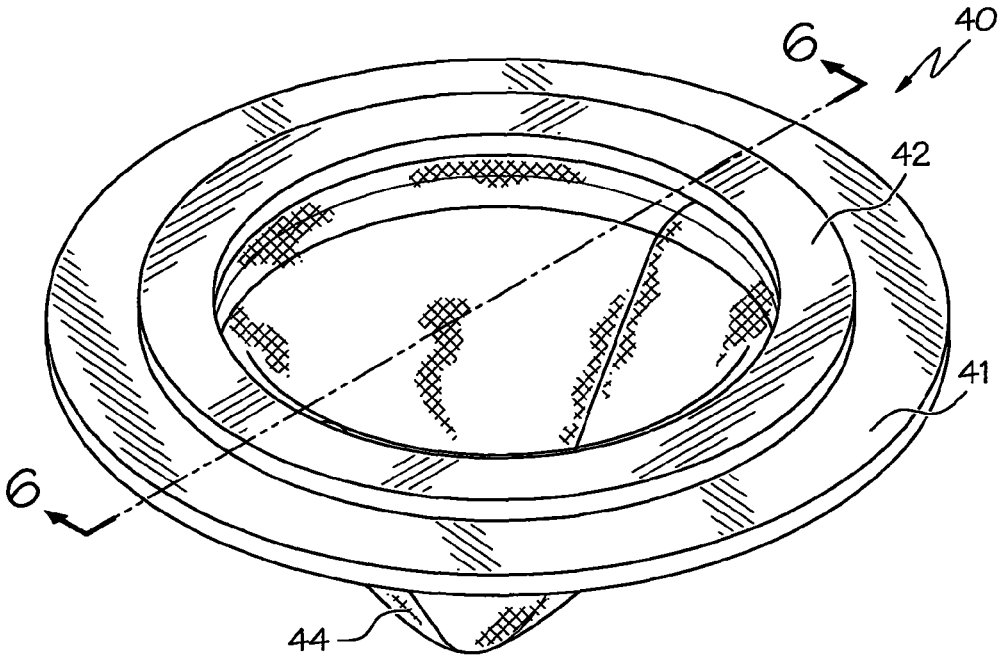
FIG. 5 is a perspective view of an alternative two-piece pre-filter assembly.
Figure 6:
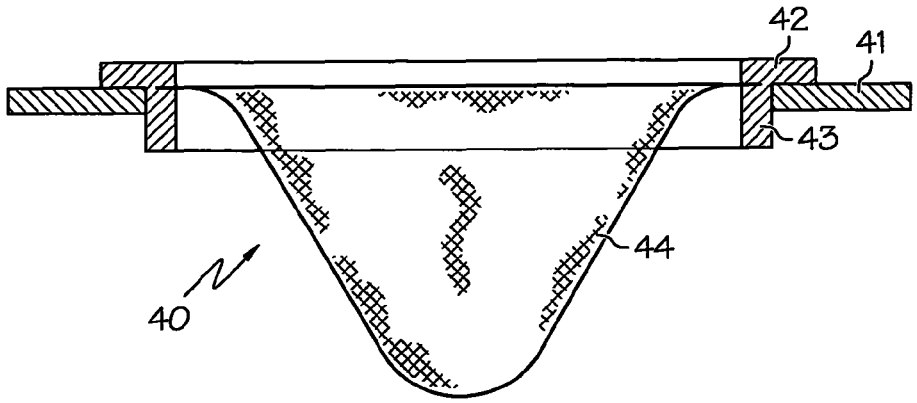
FIG. 6 is a side view in section of the alternative two-piece pre-filter assembly of FIG. 5 taken along line 6-6 thereof.

FIGS. 5 and 6 illustrate another embodiment of the invention. The pre-filter assembly 40 is a two-piece unit. It includes a skimmer collar comprised of a substantially rigid flat circular ring 41 sized to rest on the skimmer opening and a basket ring 42. The basket ring 42 has a downwardly extending lip 43. A chevron-shaped filter basket 44 is permanently trapped between the basket ring 42 and the lip 43. The lip 43 has an outside diameter slightly less than the inside diameter of the flat circular ring 41 so that it will fit down into the skimmer's inner hole while the basket ring rests on a top surface thereof. The chevron-shaped filter basket 44 is as described above with reference to FIGS. 1-4. A top edge of the basket is trapped between the basket ring 42 and lip 43.

Having described the invention in its preferred embodiment, it should be clear that modifications can be made without departing from the spirit of the invention. It is not intended that the words used to describe the invention nor the drawings illustrating the same be limiting on the invention. It is intended that the invention only be limited by the scope of the appended claims.

I claim:

1. A one piece pre-filter assembly for removing debris from swimming pool water as it enters a skimmer, said assembly comprising:

(a) a skimmer collar for placement within the skimmer to provide a substantially rigid support, said skimmer collar comprised of a substantially flat circular ring with a downwardly extending lip; and (b) a cleanable filter basket of a water porous material permanently trapped in the skimmer collar to filter debris from swimming pool water as the pool water passes through the filter basket, said filter basket having a chevron shape with an upper open top secured to the skimmer collar and a lower closed bottom, whereby the debris is filtered from the swimming pool water prior to reaching a primary filter apparatus and the filter basket is readily cleaned by inverting it and dumping debris therefrom.

2. The pre-filter assembly of claim 1 wherein the cleanable filter basket is made from a mesh material.

3. The pre-filter assembly of claim 2 wherein the cleanable filter basket is made from polypropylene with a mesh opening size of from about 600 microns to about 1000 microns.

4. The pre-filter assembly of claim 3 wherein the cleanable filter basket has an upper open-top diameter of from about three inches to about eight inches and a height of from about three inches to about five inches from the upper open top to the lowermost point of the lower closed bottom.

5. The pre-filter assembly of claim 4 wherein the skimmer collar has an outside diameter of from about five inches to about ten inches and an inside diameter of from about three inches to about eight inches.

6. The pre-filter assembly of claim 1 wherein the skimmer collar is a thermoplastic polyethylene and the filter basket is a thermoplastic polypropylene and further the skimmer collar and filter basket are melded together.

7. A two-piece pre-filter assembly for removing debris from swimming pool water as it enters a skimmer, said assembly comprising:

(a) a skimmer collar for placement within the skimmer to provide a substantially rigid support, said skimmer collar comprised of (i) a substantially flat collar ring having a center hole and (ii) a basket ring dimensioned to sit on top of the substantially flat collar ring, said basket ring having a lip extending downwardly to extend into the center hole of the substantially flat collar ring; and (b) a cleanable filter basket of a water porous mesh material permanently secured to the basket ring to filter debris from swimming pool water as the pool water passes through the filter basket, said filter basket having a chevron shape with an upper open top secured to the skimmer collar and a lower closed bottom and having a mesh opening size of about 600 microns to about 1000 microns, whereby the debris is filtered from the swimming pool water prior to reaching a main filter apparatus.

8. The pre-filter assembly of claim 7 further wherein the substantially flat collar ring of the skimmer collar is substantially rigid and is more dense than the pool water during use.

9. The pre-filter assembly of claim 7 wherein the cleanable filter basket is made from polypropylene.

10. The pre-filter assembly of claim 9 wherein the cleanable filter basket has a diameter of from about three inches to about eight inches and a height of from about three inches to about five inches.

11. The pre-filter assembly of claim 10 further wherein the skimmer collar has a thickness of from about 100 mils to about 400 mils.

12. The pre-filter assembly of claim 7 wherein the skimmer collar is made from a thermoplastic polyethylene and the cleanable filter basket is made from a thermoplastic polypropylene.

13. The pre-filter assembly of claim 12 wherein the thermoplastic polyethylene skimmer collar and the thermoplastic polypropylene filter basket are melded together.

14. A one-piece pre-filter assembly for removing debris from swimming pool water as it enters a skimmer, said assembly comprising:

(a) a skimmer collar for placement within the skimmer to provide a substantially rigid support, said skimmer collar being a substantially flat rigid circular ring with a downwardly extending lip and having a specific density greater than about 1.0 with an outside diameter of from about five inches to about ten inches and an inside diameter of from about three inches to about eight inches; and (b) a cleanable filter basket of a water porous mesh material permanently secured to the skimmer collar to filter debris from swimming pool water as the pool water passes through the filter basket, said filter basket having a chevron shape with an upper open top secured to the skimmer collar and a lower closed bottom and further having a mesh opening size of about 700 microns to about 900 microns, whereby the debris is filtered from the swimming pool water prior to reaching a main filter apparatus.

* * * * *